United States Patent [19]

Brown, Jr.

[11] Patent Number: 4,708,086

[45] Date of Patent: Nov. 24, 1987

[54] BOAT ANCHOR

[76] Inventor: Thomas E. Brown, Jr., 1153 Gooseberry Hill, Shreveport, La. 71118

[21] Appl. No.: 821,855

[22] Filed: Jan. 23, 1986

[51] Int. Cl.[4] ..... B63B 21/24

[52] U.S. Cl. ..... 114/294

[58] Field of Search ..... 114/293–310, 114/210; 119/107; 52/155, 164, 163

[56] References Cited

U.S. PATENT DOCUMENTS

| | | | |
|---|---|---|---|
| 261,334 | 7/1882 | Goldsmith | 114/300 |
| 848,634 | 4/1907 | Coghlin | 52/163 |
| 2,644,266 | 7/1953 | Updegrove | 114/294 |
| 2,738,750 | 3/1956 | Vorenkamp | 114/301 |
| 2,841,256 | 7/1958 | Clevett | 52/163 |
| 3,180,304 | 4/1965 | Brady | 114/301 |

FOREIGN PATENT DOCUMENTS

| | | | |
|---|---|---|---|
| 711754 | 7/1966 | Italy | 114/294 |

*Primary Examiner*—Joseph F. Peters, Jr.
*Assistant Examiner*—Jesûs D. Sotelo
*Attorney, Agent, or Firm*—John M. Harrison

[57] ABSTRACT

A boat anchor which is characterized by a generally triangular-shaped, solid base provided with a wedge-shaped frontal portion or blade and a cavity located in the top portion of the base, the cavity open at the top and extending to the blade and pivotally receiving a lever for attaching an anchor rope to the boat anchor. The boat anchor blade is designed to wedge into the sand or mud water bottom or to engage an underwater obstacle such as a rock, responsive to tightening of the anchor rope and pivoting of the lever with respect to the anchor base at an angle which is determined by the depth of the water and the length of the anchor line.

5 Claims, 4 Drawing Figures

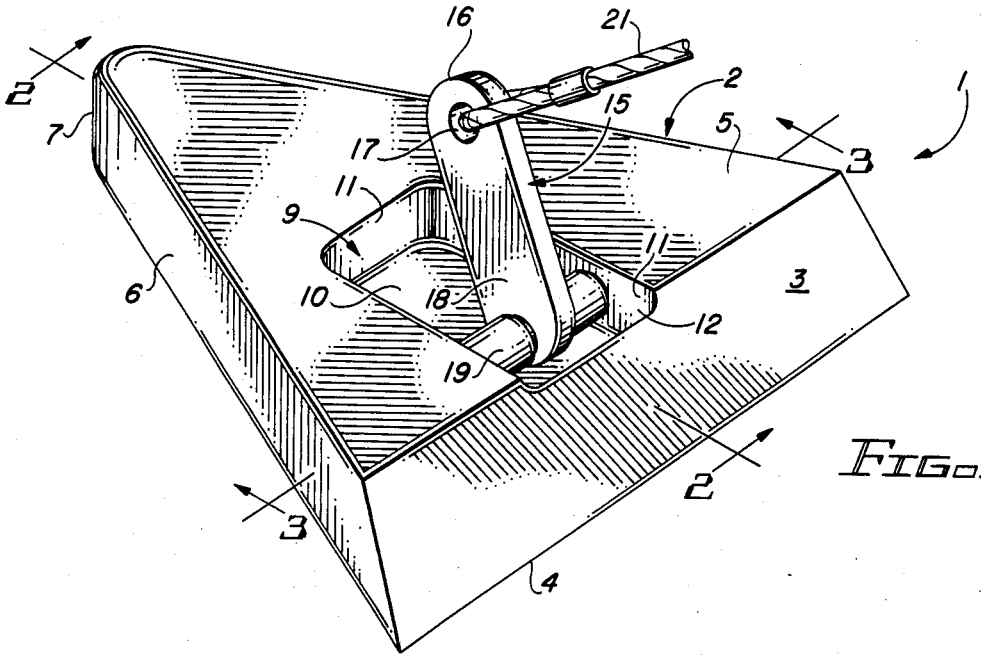
FIG. 1
FIG. 2
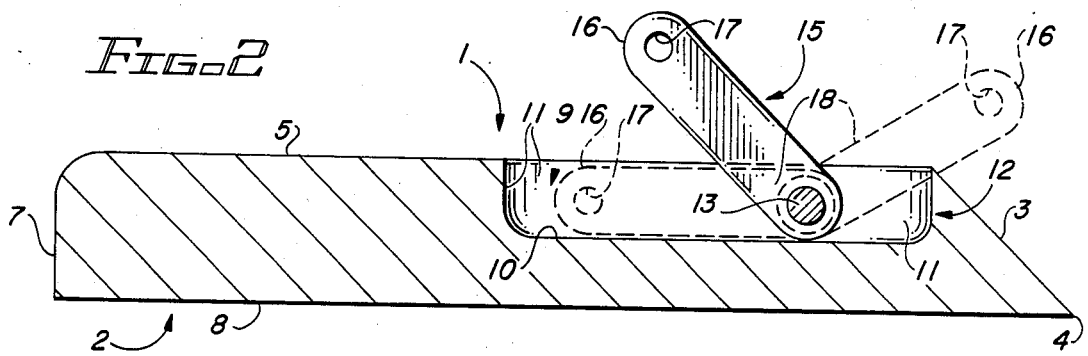
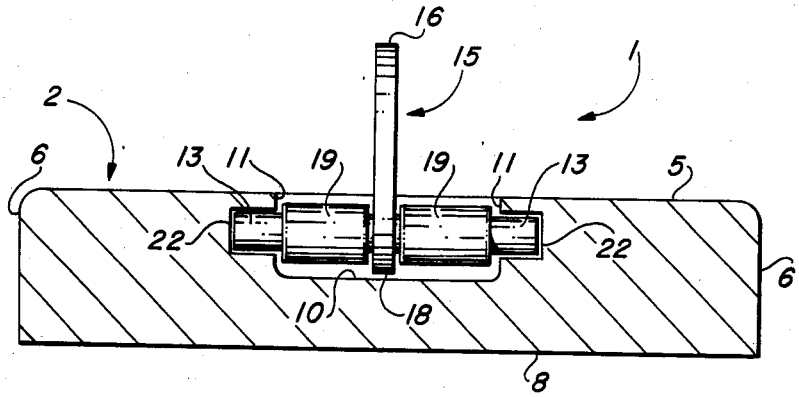
FIG. 3
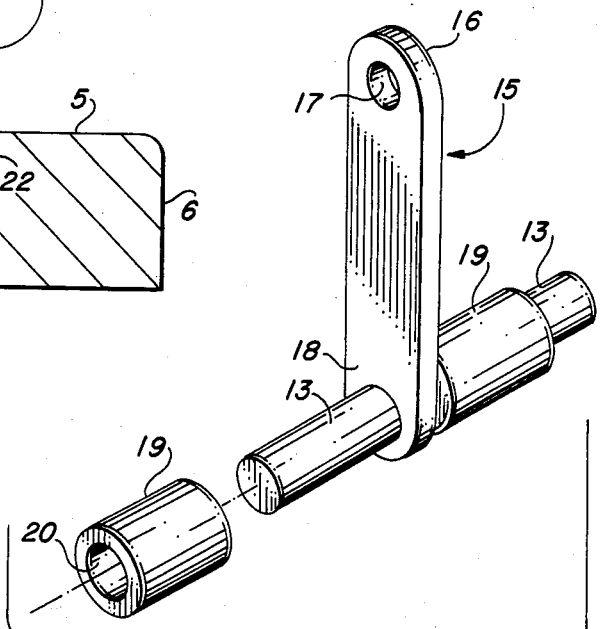
FIG. 4

BOAT ANCHOR

BACKGROUND OF THE INVENTION

1. Field of the Invention

This invention relates to boat anchors and more particularly, to a boat anchor which is characterized by a generally triangular-shaped base having a tapered frontal portion or blade which terminates in a blade edge, with a cavity provided in the base for pivotally receiving one end of a lever. An anchor rope is attached to the opposite end of the lever and in a preferred embodiment, the cavity is of sufficient size to accommodate the anchor rope and the entire lever when the anchor is not in use. When in use, the boat anchor is deployed on the water bottom and the blade edge cuts into the sand or mud of the water bottom or engages an underwater obstacle such as a rock to anchor the boat, with the lever pivotally deployed at an angle with respect to the base, which angle is determined by the length of the anchor rope and the depth of the water.

A practice of long standing which is used in anchoring large seagoing vessels is to use an anchor chain having a length which is equal to about seven times the water depth. This practice insures that a considerable length of heavy chain rests on the water bottom, which greatly aids the anchor in stabilizing the vessel. However, small boats and watercraft do not usually need or have the capacity for such a long anchor chain and rope is more often used than chain as an anchor line. Accordingly, the anchor which is used for smaller boats and watercraft must be comparatively efficient in holding the watercraft on the surface in a wind or current using a relatively short anchor chain or rope.

Another problem associated with anchoring small boats and light watercraft is that of providing an anchor which is shaped and designed to securely engage the water bottom sufficiently to stabilize the boat in a wind or current, while at the same time permitting easy retrieval of the anchor when desired. Anchor retrieval is frequently difficult, particularly in fresh water lakes and rivers, since many water bottoms are covered with a mass of fallen limbs, tree trunks, stumps, vegetation and other submerged obstacles which entangle the tines or flukes of conventional anchors. Occasionally, under circumstances where the water is deep and the anchor is ensnared by such obstacles, the anchor line must be cut and the anchor left on the water bottom in order to free the boat. Efficient anchor design for water bodies characterized by such underwater obstacles therefore dictates a compromise between the efficiency of projecting flukes or tines in engaging the water bottom or obstacles therein and stabilizing the boat, and a relatively smooth design which will not easily entangle in underwater obstacles. Boat anchors which are used to anchor small watercraft are usually left in the boat, either on the floor of the boat or in a storage locker when not in use and the anchor line is frequently either wound around the anchor or coiled beside the anchor until deployed. Thus, another problem is sometimes presented in operating the boat when the anchor is not in use, since the projecting tines and flukes in some anchors may cause injury to the boat occupants and the anchor line attached to the anchor frequently becomes snarled or entangled in and around various equipment in the boat while the anchor is not in use.

2. Description of the Prior Art

Various boat anchor designs have been proposed in the prior art for anchoring small watercraft on lakes, bayous, rivers and other waterways. Typical of these anchors is the "Boat Anchor" disclosed in U.S. Pat. No. 3,516,379, dated June 23, 1970, to H. A. Skoog. The "Anchor" described in this patent is characterized by a metal ring having a tapered interior surface with a chain extending across a diameter of the ring for connection to the anchor line, wherein the bottom edge of the ring digs into the water bottom or engages rocks or other underwater obstacles responsive to the pull on the anchor line attached to the boat.

U.S. Pat. No. 3,749,044, dated July 31, 1973, to P. J. Klaren, discloses an "Anchor" which includes a shaped fluke portion formed by a flat plate with a shank fixedly secured to the plate and projecting from the plate at an acute angle of less than 45° . The plate is shaped in a triangular configuration to define three points for engaging the water bottom in order to stabilize the anchor when tension is applied to an anchor line attached to the extending end of the shank. An "Anchor Particularly Suitable for Small Boats" is disclosed in U.S. Pat. No. 3,908,575, dated Sept. 30, 1975, to Mario Giolfo. This anchor is characterized by a round anchor portion having a body which is parallelogram-shaped in plan view and is provided with an extending T-shaped shank located at a selected point on the anchor portion of the anchor. The shank is oriented in fixed relationship in the anchor portion and the parallelogram shape of the anchor portion is designed to engage the water bottom and/or an obstacle or obstacles in the water bottom. U.S. Pat. No. 4,383,493, dated May 17, 1983, to Takmatsu, et al, discloses an anchor which. includes an approximately frusto conical-shaped main body portion with a chain attached to a clevis provided in the top of the body portion, wherein tension applied on the chain causes one edge of the main body to dig into the water bottom or engage underwater obstacles and stabilize a boat to which the opposite end of the chain is attached. A "Boat Anchor" is disclosed in U.S. Pat. No. 4,385,584, dated May 31, 1983, to Lee S. Simpson, III. The Simpson "Boat Anchor" includes an anchor shank having a pair of flat, pointed flukes pivotally connected to the shank and supported for angular displacement about an axis which is normally related to the longitudinal axis of the shank. Motion-limiting stops are mounted on the shank for arresting the pivotal motion of the flukes relative to the shank. The shank is also provided with a pivotal coupling interposed between the ends thereof and with a shear pin for stabilizing the shank, which shear pin is adapted to shear when subjected to angularly applied loads of predetermined magnitude. The shear pin facilitates recovery of the anchor when the anchor becomes entangled or snarled in underwater obstacles on the water bottom. U.S. Pat. No. 4,523,539, dated June 18, 1985, to Gerald M. Granger, discloses an improved boat anchor assembly which is designed to prevent anchor snags and loss of the anchor, which assembly is characterized by an anchor chain attached to a sleeve removably engaging a shank extended from fixed attachment to the anchor. The sleeve automatically locks to the shank in a predetermined manner to change the pivot point in the engagement of the anchor chain and the shank to effectively free the anchor from entangling underwater obstacles.

It is an object of this invention to provide a new and improved anchor which is easily deployed on and retrieved from a water bottom.

A further object of the invention is to provide a boat anchor which is characterized by a low profile and a cavity for recessing the anchor rope lever and receiving the anchor rope.

Another object of this invention is to provide a new and improved boat anchor which has no fixed extending or projecting flukes or protuberances for entangling in obstacles on the water bottom and is therefore easily retrieved from the water bottom.

Yet another object of the invention is to provide a boat anchor for watercraft, which anchor is characterized by a low profile and a pivoting lever for attaching the anchor line, whereby when the anchor is in non-functional configuration in the watercraft, it presents a substantially flat top surface with no projecting flukes, shanks, sharp edges or protuberances to injure the occupants or entangle in the anchor rope or chain or in other lines, ropes or tackle located in the watercraft.

Still another object of this invention is to provide a new and improved boat anchor which is useful for anchoring small watercraft and boats of various design, which boat anchor includes a generally triangular-shaped, solid body portion having a beveled blade segment terminating in a blade edge along one face of the body portion and provided with a pivoting lever located in a cavity facing the blade, for efficiently stabilizing the boat anchor on the water bottom and yet facilitating easy retrieval of the boat anchor from the water bottom and storage of the boat anchor in the watercraft.

Another object of this invention is to provide a new and improved boat anchor for small watercraft, which anchor is characterized by a generally triangular-shaped, solid body portion and a cavity provided in the body portion for receiving the anchor line when the anchor is not in use, the cavity also accomodating a pivoting lever, the free end of which lever is deployed upwardly and forwardly responsive to the pull of an anchor line attached to the lever when the anchor is in use and is folded into the cavity along with the anchor line when the anchor is located in the watercraft.

SUMMARY OF THE INVENTION

These and other objects of the invention are provided in a new and improved boat anchor which includes a generally triangular-shaped anchor body having a forwardly extending, tapered blade provided along one edge or leg, the blade terminating in a knife edge at the bottom face of the anchor, with a cavity located in the top face of the anchor body and terminating at the blade and a pivoting lever mounted in the cavity for attaching an anchor line, wherein the blade engages the water bottom or an underwater obstacle and secures the boat when the anchor is in use and the anchor is easily removed from obstacles on the water bottom when retrieved.

BRIEF DESCRIPTION OF THE DRAWING

The invention will be better understood by reference to the accompanying drawing, wherein:

FIG. 1 is a perspective view of a preferred embodiment of the boat anchor of this invention;

FIG. 2 is a longitudinal sectional view, taken along line 2—2 of the boat anchor illustrated in FIG. 1;

FIG. 3 is a transverse sectional view, taken along line 3—3 of the boat anchor illustrated in FIG. 1; and FIG. 4 is a perspective view of a preferred lever and mounting pin for mounting in the body of the boat anchor illustrated in FIGS. 1-3.

DESCRIPTION OF THE PREFERRED EMBODIMENTS

Referring initially to FIGS. 1-3 of the drawing, the boat anchor of this invention is generally illustrated by reference numeral 1. In a preferred embodiment, the boat anchor 1 is generally characterized by a generally triangular-shaped, solid base 2, provided with a tapering blade 3 extending along one leg thereof, which blade 3 tapers from the top surface 5 to the bottom surface 8 of the base 2 and terminates in a sharp blade edge 4. The generally flat top surface 5 extends in substantially perpendicular relationship with respect to the remaining two legs 6, which intersect at the round heel 7 of the base 2. The bottom surface 8 of the base 2 is also flat and extends substantially parallel to the top surface 5. A cavity 9 is provided in the base 2 rearwardly of the blade 7 and is defined by cavity sides 11 which extend from a flat cavity floor 10, as illustrated. In a preferred embodiment of the invention the cavity 9 extends to the blade 3, to define a notch 12 in the blade 3. It will be appreciated by those skilled in the art that the cavity 9 is sized to accomodate an anchor rope 21, illustrated in FIG. 1, for storage purposes when the boat anchor 1 is not in use, as hereinafter described.

The anchor rope 21 is anchored to the rope end 16 of a lever 15, which extends into the cavity 9 and the mount end 18 of the lever 15 is mounted on a pivot pin 13, which is seated in the pin seats 22 provided in the cavity sides 11 of the base 2, as illustrated in FIG. 3 of the drawing. Furthermore, as illustrated in FIGS. 1 and 4, a pair of shims 19, each having a shim bore 20, are slidably fitted on the pivot pin 13. The shims 19 allow the lever 15 to easily pivot from a position completely enclosed in the cavity 9 as illustrated in a first phantom configuration illustrated in FIG. 2, to a position outwardly of the cavity 9, as illustrated in FIGS. 1 and 3. The rope end 16 of the lever 15 is further characterized by a rope aperture 17, through which the anchor rope 21 is knotted. The opposite end of the anchor rope 21 is attached to a boat or watercraft (not illustrated) in order to anchor and stabilize the watercraft on the surface of a waterway.

As further illustrated in FIG. 2 of the drawing it will be appreciated by those skilled in the art that when the anchor rope 21 is attached to the rope end 16 of the lever 15, the lever 15 is free to pivot with rotation of the pivot pin 13 responsive to random periods of tension and slack in the anchor rope 21. Furthermore, under circumstances where the anchor line 21 is subjected to tension due to drift of the boat on the surface of the water, the lever 15 is pivoted forwardly, as illustrated in phantom in FIG. 2, which causes the blade edge 4 of the blade 3 to cut into the sand or mud of the water bottom or engage an underwater obstacle or obstacles and stabilize the boat from further drift. Furthermore, when it is desired to lift the boat anchor 1 from the water bottom, the boat is positioned over the boat anchor 1 and the lever 15 is oriented in the position illustrated in FIG. 3, in substantially perpendicular relationship with respect to the top surface 5 of the base 2. The boat anchor 1 can then be easily retrieved and lifted into the boat without entanglement in underwater obstacles.

It will be appreciated by those skilled in the art that the boat anchor 1 of this invention incorporates a design which not only is extremely efficient in securely engaging water bottoms and/or underwater obstacles of substantially any description and stabilizing the watercraft from drift on the water surface, but also allows easy retrieval of the anchor without entangling in underwater obstacles. The design does not utilize rigid flukes or protuberances or projections and therefore minimizes even a chance entanglement in underwater obstacles which might prevent it from being lifted to the boat. Furthermore, the boat anchor 1 of this invention is simple in design and is easily stored on the floor of the boat with the lever 15 pivoted into the cavity 9, as illustrated in phantom in FIG. 2. The anchor rope 21 is also easily coiled or looped in the cavity 9 around the lever 15, to prevent entanglement with equipment in the boat and since the blade edge 4 of the blade 3 is located flat on the deck or interior surface of the boat or watercraft when the boat anchor 1 is not in use, it cannot cause injury to occupants of the watercraft. Similarly, the lever 15 is pivotable through a 180 degree arc and can be pivoted into the cavity 9 and therefore presents no accident hazard to the watercraft occupants. The boat anchor 1 is also compact and therefore requires minimum space for storage, a factor which is very important, particularly in small boats and watercraft having limited access for the occupants and the necessary gear and tackle.

While the preferred embodiments of the invention have been described above, It will be recognized and understood that various modifications may be made therein and the appended claims are intended to cover all such modifications which may fall within the spirit and scope of the invention.

Accordingly, having described my invention with the particularity set forth above, what is claimed is:

1. A boat anchor for stabilizing a boat on a water body by means of an anchor rope extending between the boat anchor and the boat, said boat anchor comprising a generally triangular-shaped base member; a tapered blade shaped in one leg of said base member; a cavity provided in said base member, with the floor of said cavity extending at one end thereof to said blade and a lever having one end extending into said cavity and pivotally carried by said base member in said cavity and the opposite end of said lever carrying the anchor rope, whereby said lever is pivotally disposed with both ends inserted entirely in said cavity in recessed relationship when said boat anchor is not in use and pivotally deployed from said cavity toward said blade responsive to tension in the anchor rope when said anchor is functionally depolyed on a water bottom.

2. The boat anchor of claim 1 further comprising a pivot pin spanning said cavity and pivotally carried by said base member and wherein said one end of said lever is fixed to said pivot pin.

3. The boat anchor of claim 2 further comprising a pair of shims rotatably provided on said pivot pin on both sides of said one end of said lever.

4. The boat anchor of claim 3 further comprising a blade edge terminating said tapered blade.

5. A boat anchor for anchoring a boat on a water body using an anchor rope extending between the boat anchor and the boat, said boat anchor comprising a generally triangular-shaped, solid base member; a tapered blade provided in one leg of said base member, said tapered blade terminated by a blade edge; a cavity provided in said base member, with the floor of said cavity extending at one end to said blade; a lever having one end extending into said cavity and a lever pin pivotally carried by said base member in said caity, with said one end of said lever fixedly attached to said lever pin and the opposite end of said lever attached to the anchor rope; and a pair of shims rotatably carried by said lever pin, whereby said lever is pivotally disposed in said cavity when said boat anchor is not in use and pivotally deployed from said cavity toward said blade responsive to tension in the anchor rope when said anchor is functionally deployed on a water bottom.

* * * * *